US005932820A

United States Patent [19]

Kihara

[11] Patent Number: 5,932,820

[45] Date of Patent: Aug. 3, 1999

[54] DAMPER LEVER FOR GRAND PIANO

[75] Inventor: Tsutomu Kihara, Shizuoka-ken, Japan

[73] Assignee: Kabushiki Kaisha Kawai Gakki Seisakusho, Shizuoka-ken, Japan

[21] Appl. No.: 08/961,216

[22] Filed: Oct. 30, 1997

[30] Foreign Application Priority Data

Nov. 1, 1996 [JP] Japan ..... 8-307370

[51] Int. Cl.[6] ..... G10C 3/00

[52] U.S. Cl. ..... 84/216

[58] Field of Search ..... 84/216, 217

[56] References Cited

U.S. PATENT DOCUMENTS 3,583,271 6/1971 Corwin et al. ..... 84/236

*Primary Examiner*—Jeffrey W. Donels

*Attorney, Agent, or Firm*—Evenson, McKeown, Edwards & Lenahan, PLLC

[57] ABSTRACT

A damper lever for a grand piano is provided for realizing a significantly cost reduction, a higher dimensional accuracy at a fabricating stage and a higher weathering resistance, and for permitting lead pieces to be stably fixed in a lever body without causing fracture or deformation of the lever body. The damper lever for a grand piano is composed of a lever body formed of a molded plastic material, and having a fitting recess formed on one side surface thereof and an inserting hole extending from the fitting recess and open to the other side surface of the lever body, and a plurality of lead pieces each having a head and a shaft extending from the head. Each lead piece has its head inserted into the inserting hole of the lever body and the head fitted in the fitting recess of the lever body, and a top end of the shaft is caulked to fix each lead piece in the lever body.

4 Claims, 3 Drawing Sheets

DAMPER LEVER FOR GRAND PIANO

BACKGROUND OF THE INVENTION

1. Field of the Invention

The present invention relates to a damper lever for a grand piano which is used as a component for a damper assembly in a grand piano.

2. Description of the Related Art

A damper assembly in a grand piano is provided for releasing and clamping a string in association with operations on a keyboard and so on to allow sound to generate and prevent sound from generating. In this event, when a key on a keyboard is depressed, the damper lever of the damper assembly is directly driven by the key to rotate, causing a damper head coupled to the damper lever to rise so that the damper head is moved away from the string, thereby releasing the string before a hamper strikes the string to permit the string to vibrate, thus allowing sound to generate. On the other hand, after the depressed key is released, the damper lever rotates in the reverse direction by its own weight to cause the damper head to fall so that the damper head comes in contact with the string to hold the string from the above, thus stopping the sound from generating.

Referring now to FIG. 1, a damper lever 21 for a conventional grand piano is composed of a lever body 22 and a plurality of (for example, three) lead pieces 23 embedded in the lever body 22. The lever body is made of a solid wood such as maple, magnolia, or the like, and is made in a rectangular rod shape of a predetermined shape and dimension by cutting such wood. The lever body 22 is formed with a plurality of holes 24 for embedding lead pieces 23, a wire flange mounting recess 25 for mounting a wire flange (not shown), and so on by numerical control (NC) machining or the like. Each lead embedding hole 24, which has a dimension to exactly fit the lead piece 23 therein, is formed through the lever body 21 from one to the other surfaces. The lever body 22 is also provided with a pilot screw 26 with a tapping screw 26*a* attached to the bottom surface thereof for controlling the height of the damper lever 21 in order to appropriately adjusting the timing of stopping sound.

The lead pieces 23 are provided for increasing the self weight of the damper lever 21 to ensure that the damper lever stops sound after a key is released. Thus, each lead piece has a predetermined weight in accordance with an associated sound range and is formed in a cylindrical shape. The lead piece 23 is fixed in the lever body 22 by caulking. More specifically, as illustrated in FIG. 2A, the lever body 22 is placed on a base 27 with its side surfaces facing the upward and downward directions, and a lead piece 23 is inserted into the lead embedding hole 24. Subsequently, the tip of a tool 28 is placed on the exposed side surface of the lead piece 23, and the head of the tool 28 is struck with a hammer (not shown) to deform the lead piece 23 in the radial direction as illustrated in FIG. 2B. Thus, with a pressure produced by the striking, the entire outer peripheral surface of the lead piece 23 is brought into contact with the wall of the lead embedding hole 24 to fix the lead piece 23 in the lever body 22.

However, since the conventional damper lever 21 as mentioned above employs a rather expensive solid wood as the material for the lever body 22, it suffers from a high material cost. In addition, the machining required to form the lever body 22 with the lead embedding holes 24 and so on causes a higher machining cost. Further, since the lever body 22 is fabricated by cutting wood, an available accuracy in dimension is limited. To compensate for the low machining accuracy, it is necessary to finely control the height of the damper lever 21 with the pilot screw 26, thus requiring time and labor for the fine adjustment. Furthermore, since the lever body 22 is made of wood, its weathering resistance and strength are limited. For example, the influence of humidity and aging may cause deformation such as bowing and dimensional change in the lever body 22. In addition, during the control of the height of the damper lever 21 with the pilot screw 26, the thread formed in the bottom of the lever body 22 may be broken due to a clamping torque of the tapping screw 26 too large for the thread to withstand.

To solve the inconveniences as mentioned above, it may be envisioned that the wood be replaced with, for example, a relatively hard plastic material. However, since the plastic material generally has a toughness lower than wood, other inconveniences may be caused by the replacement of the material for the lever body 22. For example, an impact load applied to the lever body 22 when a lead piece 23 is caulked may cause a fracture in a caulked portion of the lever body 22, a deformation of the lever body as a whole, and so on.

SUMMARY OF THE INVENTION

The present invention has been made to solve the problems mentioned above. An object of the present invention is to provide a damper lever for a grand piano which can be fabricated at a significantly lower cost, provide a higher dimensional accuracy at a fabricating stage and a higher weathering resistance, and permit lead pieces to be stably fixed in the lever body.

To achieve the above object, a damper lever for a grand piano according to the present invention comprises a lever body formed of a molded plastic material. The lever body has a fitting recess formed on one side surface thereof and an inserting hole extending from the fitting recess and open to the other side surface of the lever body. A plurality of lead pieces each having a head and a shaft extending from the head are provided, wherein each lead piece has its head inserted into the inserting hole of the lever body and the head fitted in the fitting recess of the lever body. A top end of the shaft is caulked to fix each lead piece in the lever body.

According to the damper lever for a grand piano, each lead piece is fixed in the lever body by inserting the shaft into the inserting hole of the lever body, fitting the head in the fitting recess of the lever body, and caulking the top end portion of the shaft. In other words, each lead piece is fixed in the lever body in such a manner that the head and the caulked top end portion of the shaft sandwiches the lever body so as to prevent the lead piece from coming off, so to say, as is the case of using a rivet. Therefore, a much smaller caulking force is required to fix the lead piece in the lever body so that an impact load acting on the lever body can be significantly reduced, as compared with the conventional way which caulks a cylindrical lead piece to cause deformation in the radial direction to bring the entire outer peripheral surface of the lead piece into contact with the wall of a lead embedding hole. Thus, it is possible to stably fix the lead pieces in the lever body 2 without causing fracture, deformation, and so on, due to the caulking, in the lever body made of a plastic material.

As a result, advantages of the lever body made of a plastic material are realized. Specifically, the plastic lever body provides a reduced material cost and a higher weathering resistance, in comparison with a lever body made of a wood. In addition, since the lever body molded by an appropriate molding method enables the fabrication of the lever body with a higher dimensional accuracy as well as the simultaneous formation of the lead embedding holes, the wire flange mounting recesses, and so on during the molding, subsequent hole machining and so on can be eliminated, thereby reducing a machining cost as well.

Preferably, in this case, the lever body is integrally molded by injection molding. The employment of the injection molding as a method of molding the lever body is particularly advantageous in enabling high speed mass production of the lever body, thereby resulting in a lower manufacturing cost.

The plastic material is preferably polyacetal. Polyacetal is superior in creep resistance, fatigue resistance, and humidity sensitivity, and may be processed in normal injection molding. It is therefore possible to provide a lever body which is particularly excellent in strength, dimensional stability, form maintainability, and so on. For example, since a sufficient torque resistance can be ensured against clamping torque of the tapping screw applied when the pilot screw is mounted, the thread can be prevented from being broken. In addition, by reducing the amount of creep deformation caused by residual stress due to caulking of the lead piece, the lead piece can be stably held for a long term.

DESCRIPTION OF THE PREFERRED EMBODIMENT

Figure 1:
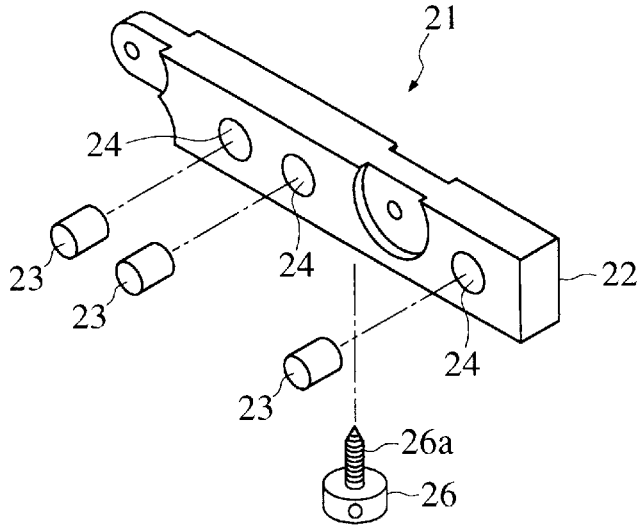
FIG. 1 PRIOR ART
FIG. 1 is an exploded perspective view illustrating the structure of a prior art damper lever.
Figure 2A:
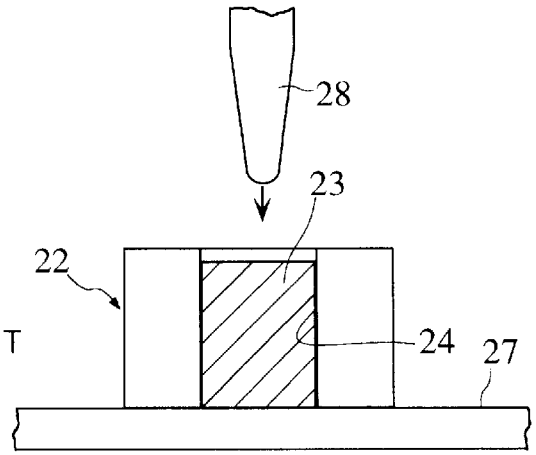
FIG. 2A PRIOR ART
FIGS. 2A and 2B are cross-sectional views illustrating how lead pieces are embedded in a lever body in the prior art damper lever of FIG. 1.
Figure 2B:
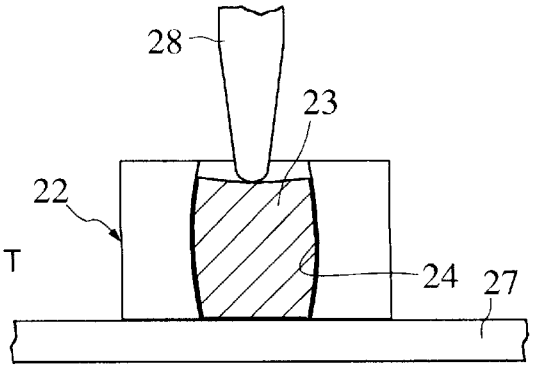
FIG. 2B PRIOR ART
Figure 3:
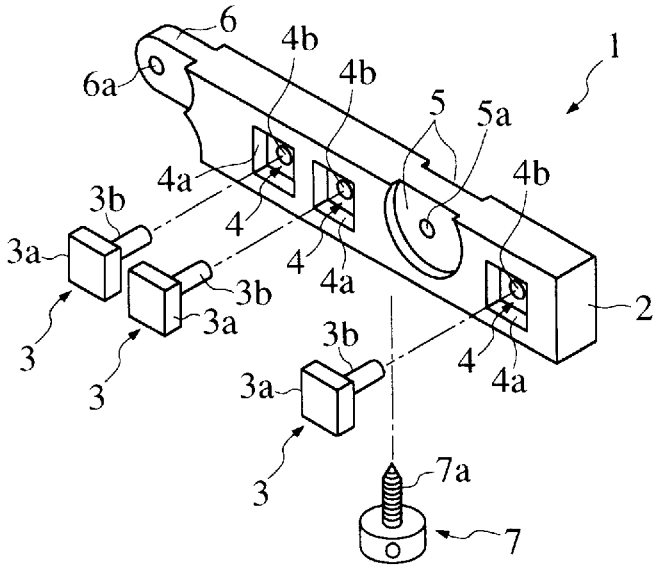
FIG. 3 is an exploded perspective view illustrating the structure of a damper lever according to one embodiment of the present invention.

The preferred embodiment of the present invention will hereinafter be described in detail with reference to the accompanying drawings. FIG. 3 illustrates a damper lever 1 for a grand piano to which the present invention is directed. As illustrated, the damper lever 1 is composed of a lever body 2 and a plurality of (for example, three) lead pieces 3 embedded therein.

The lever body 2 is formed, for example, by integral molding such as injection molding of polyacetal into a rod having a rectangular shape in cross-section and a predetermined dimension. The lever body 2 is formed with three lead embedding holes 4 parallelly arranged in the depth direction thereof, a pair of wire flange mounting recesses 5 in an intermediate portion thereof, and a damper lever flange mount 6 at the rear end thereof. Advantageously, these members are formed simultaneously with the molding of the lever body 2.

Each lead embedding hole 4 comprises a substantially square fitting recess 4*a* formed in one side surface of the lever body 2 and an inserting hole 4*b* having a circular shape in cross-section which extends from the center side of the fitting recess 4*a* and is open to the other side surface of the lever body 2. Also, as illustrated in FIG. 4, the inserting hole 4*b* is formed with a tapered opening 4*c* to have a wider dimension.

The pair of wire flange mounting recesses 5, which are provided for rotatably mounting a wire flange 12 (see FIG. 5), later described, have their upper edges open to the top surface of the lever body 2, and are formed with a rotating hole 5*a* extending through the wall of the lever body 2 between the recesses 5. The damper lever flange mount 6, which is provided for rotatably mounting the lever body 2 to a damper lever flange 11 (see FIG. 5), later described, is formed with a rotating hole 6*a* extending therethrough. Further, on the bottom surface of the lever body 2, a pilot screw 7 with a tapping screw 7*a* is mounted for controlling the height of the damper lever 1 in order to appropriately adjust the timing of stopping sound.

The lead pieces 3 in turn are provided for increasing the self weight of the damper lever 1 to ensure that the damper lever 1 stops sound after a key is released and have a predetermined weight in accordance with an associated sound range. Each lead piece 3 is composed with a head 3*a*, substantially square in cross-section, and a shaft 3*b*, circular in cross-section, extending from the head 3*a*. These head 3*a* and the shaft 3*b* are dimensioned so as to precisely fit in the fitting recess 4*a* and the inserting hole 4*b* of the lead embedding hole 4 in the lever body 3, respectively. The lead piece 3 is fixed to the lever body 2 by caulking the shaft 3*b* with the head 3*a* and the shaft 3*b* fitted in the lead embedding hole 4 as described above.

Figure 4A:
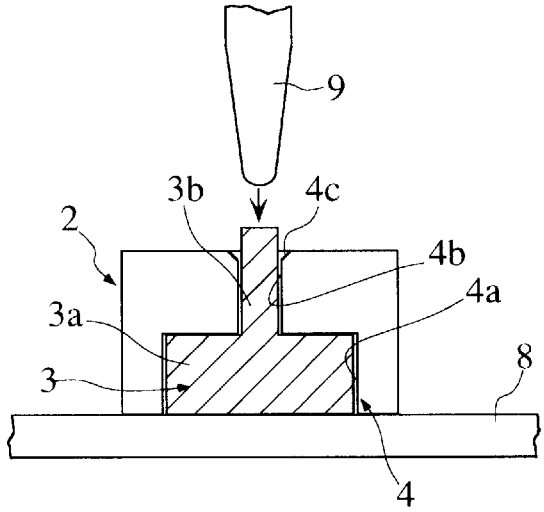
FIGS. 4A and 4B are cross-sectional views illustrating how lead pieces are embedded in a lever body in the damper lever of FIG. 3.
Figure 4B:
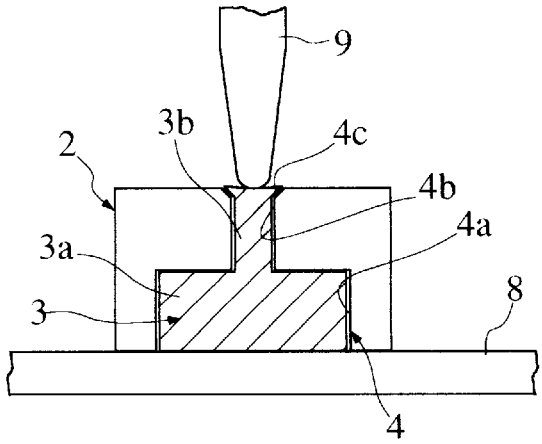

More specifically, as illustrated in FIG. 4A, the shaft 3*b* of the lead piece 3 is inserted into the inserting hole 4*b* of the lead embedding hole 4 in the lever body 2, and the head 3*a* is fitted in the fitting recess 4*a*. Then, the lever body 2 is placed on a base 8 made of a plate or the like, with two side surfaces of the lever body 2 facing the upward and downward directions. Subsequently, the tip of a tool 9 is placed on the end surface of the shaft 3*b* of the lead piece 3, and the head of the tool 28 is struck with a hammer (not shown). This causes a top end portion of the shaft 3*b* of the lead piece 3 to deform in the radial direction and collapse as illustrated in FIG. 4B. The collapsed portion of the shaft 3*b* is pressed onto the wall of the tapered opening of the lead embedding hole 4, thereby fixing the lead piece 3 in the lever body 2.

In the damper lever 1 of this embodiment as described above, each lead piece 3 is fixed in the lever body 2 in such a manner that the head 3*a* and the caulked top end portion of the shaft 3*b* sandwiches the lever body 2 so as to prevent the lead piece 3 from coming off, so to say, as is the case of using a rivet. Therefore, a much smaller caulking force is required to fix the lead piece 3 in the lever body 2. As such an impact load acting on the lever body 2 can be significantly reduced, as compared with the conventional way which caulks a cylindrical lead piece to cause deformation in the radial direction to bring the entire outer peripheral surface of the lead piece into contact with the wall of a lead embedding hole. Thus, it is possible to stably fix the lead pieces 3 in the lever body 2 without; causing fracture, deformation, and so on, due to the caulking, in the lever body 2 made of a plastic material.

As a result, advantages of the lever body 2 made of a plastic material can be provided. Specifically, the plastic lever body 2 realizes a reduced material cost and a higher weathering resistance, in comparison with a lever body made of wood. In addition, since the lever body 2 integrally molded by injection molding enables the fabrication of the lever body 2 with a higher dimensional accuracy and a higher production efficiency as well as the simultaneous formation of the lead embedding holes 4, the wire flange mounting recesses 5, and so on during the molding. Accordingly subsequent hole machining and so on can be eliminated, thereby reducing a machining cost as well.

Further, since polyacetal is selected from a number of thermoplastic materials as the material for the lever body 2 because of its superior creep resistance, fatigue resistance, and humidity sensitivity, the resulting lever body 2 is particularly excellent in strength, dimensional stability, form maintainability, and so on. For example, since a sufficient torque resistance can be ensured against clamping torque of the tapping screw 7*a* applied when the pilot screw 7 is mounted, the thread can be prevented from being broken. In addition, by reducing the amount of creep deformation caused by residual stress due to caulking of the lead piece 3, the lead piece 3 can be stably held for a long term.

Figure 5:
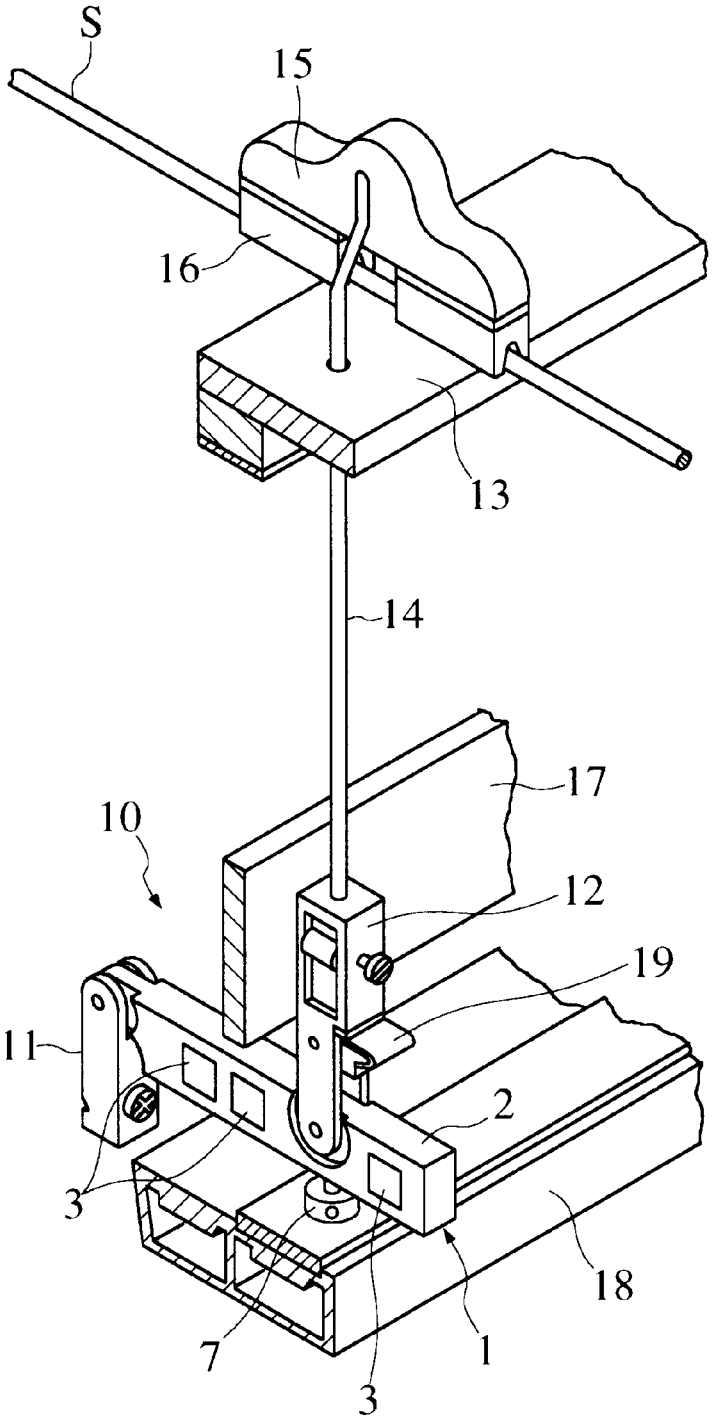
FIG. 5 is a perspective view illustrating an example of a damper assembly assembled using the damper lever of FIG. 3.

Next, the structure and operation of a damper assembly 10 assembled using the foregoing damper lever 1 will be briefly described with reference to FIG. 5. The damper assembly 10 has a damper lever flange mount 6 of the damper lever 1 rotatably mounted to a damper lever flange 11 and the wire flange 12 rotatably mounted to the wire flange mounting recesses 5. A lower end of the damper wire 14 guided by a guide holder 13 is fixed to the wire flange 12. A damper head 15 is attached to an upper end of the damper wire 14, such that the damper head 15 can touch a string S stretched in the horizontal direction from above through a damper felt 16.

In the damper assembly 10 structured as described above, when a key, not shown, is depressed, the damper lever 1 is rotated by a rear end of the key flipping the front end of the damper lever 1, causing the damper head 15 coupled thereto to rise to leave the string S. Thus, the damper head 15 releases the string S before the hammer (not shown) strikes the string S to permit the string S to vibrate, thus generating sound. A maximum rotating angle of the damper lever 1 in this event is regulated by a stop rail 17. On the other hand, when the key is released, the damper lever 1 rotates in the reverse direction due to its self weight increased by the lead pieces 3 to cause the damper head 15 to lower to come in contact with the string S and to hold the string S from the above, thus preventing the sound from generating.

The pilot screw 7 mounted to the lever body 2 is carried on a lifting rail 18, such that the pilot screw 7 is controlled with respect to its vertical position to appropriately adjust the timing of stopping sound for each key as well as to knock up the lifting rail 18 by a rod (not shown) in association with an operation on a loud pedal (not shown) to hold all damper levers 1 at an upper position to produce a so-called loud effect. Further, a rod (not shown) associated with a sostenuto pedal (not shown) operated after depression of a key is engaged with a sostenuto tangent 19 arranged below the wire flange 12 to produce a so-called sostenuto effect.

It will be understood by those skilled in the art that the present invention is not limited to the foregoing embodiment but may be implemented in a variety of ways. For example, while the foregoing embodiment has shown an example of an injection molded lever body made of polyacetal, any other appropriate molding method and plastic material may of course be employed. Also, while the head of the lead piece has been shown to be substantially square in plan, the head may be of any other shape, for example, a circular shape. However, the shape shown in the foregoing embodiment is advantageous in view of a space efficiency for the lever body. It is also possible to modify details in structure and so on without departing from the spirit and scope of the present invention.

As described above, the damper lever for a grand piano of the present invention is advantageous in that it realizes a significant cost reduction, it is excellent in dimensional accuracy and weathering resistance, the lead pieces can be stably fixed in the lever body without causing fraction or deformation of the lever body, and so on.

What is claimed is:

1. A damper lever for a grand piano adapted to, by way of its own weight, prevent sound from being generated by a piano string comprising:

a lever body formed of a molded plastic material, said lever body having a fitting recess formed on one side surface thereof, and an inserting hole extending from said fitting recess and open to the other side surface of said lever body; and a plurality of lead pieces attached to said lever body to add weight thereto, each of said lead pieces having a head and a shaft extending from said head, each said lead piece having its shaft inserted into said inserting hole of said lever body and said head fitted in said fitting recess of said lever body, a top end of said shaft being caulked to fix each said lead piece in said lever body.

2. A damper lever for a grand piano according to claim 1, wherein said lever body is integrally molded by injection molding.

3. A damper lever according to claim 1, wherein said plastic material is polyacetal.

4. A damper lever according to claim 2, wherein said plastic material is polyacetal.

* * * * *